US005450708A

United States Patent [19]

Lashyro

[11] Patent Number: 5,450,708

[45] Date of Patent: Sep. 19, 1995

[54] FLEXIBLE PACKAGING OF STACKED ARTICLES

[75] Inventor: Jeffrey A. Lashyro, Crosby, Minn.

[73] Assignee: Riverwood International Corporation, Denver, Colo.

[21] Appl. No.: 123,879

[22] Filed: Sep. 20, 1993

[51] Int. Cl.[6] ..... B65B 13/02; B65B 53/00; B65B 53/02; B65B 35/50

[52] U.S. Cl. ..... 53/399; 53/398; 53/441; 53/442; 53/447; 53/449

[58] Field of Search ..... 53/48.2, 48.4, 48.5, 53/48.7, 397, 398, 399, 441, 442, 445, 447, 157, 176, 171, 154, 540

[56] References Cited

U.S. PATENT DOCUMENTS 2,277,408 3/1942 Molins et al. ..... 53/540 X
3,201,912 8/1965 Wozniak .
3,481,107 12/1969 Andblad et al. ..... 53/48.2 X
3,568,393 3/1971 King et al. ..... 53/445 X
3,660,961 5/1972 Ganz ..... 53/445 X
3,664,089 5/1972 Keck ..... 53/157 X
3,850,282 11/1974 Calvert et al. .
3,861,530 1/1975 Calvert .
3,895,476 7/1975 Burns ..... 53/449 X
4,036,362 7/1977 Ullman ..... 53/398 X
4,481,711 6/1989 Lems et al. ..... 53/398
5,129,211 7/1992 Anderson ..... 53/399

*Primary Examiner*—Linda Johnson
*Attorney, Agent, or Firm*—Anthony G. Eggink

[57] ABSTRACT

A method to form and package stacked article groups utilizing flexible packaging materials. The method provides first and second streams of article groups which are directed to a supply of flexible packaging material, such as shrink or stretch film, to form stacked article groups.

12 Claims, 1 Drawing Sheet

FLEXIBLE PACKAGING OF STACKED ARTICLES

BACKGROUND OF THE INVENTION

This invention relates to the packaging of stacked articles. Particularly, this invention relates to methods of forming and packaging stacked articles utilizing flexible packaging materials.

The packaging of stacked articles, such as beverage and food containers and the like, has been found to be an economical and well accepted means to distribute products. These benefits are realized from both a distributor and consumer standpoint. The primary limitation to the distribution of stacked articles, such as stacked beverage cans, has been the ability to form and package such stacked article groups in a fast and economical manner. The methods of this invention utilize flexible packaging materials to form and provide such stacked article groups.

SUMMARY OF THE INVENTION

The present invention provides a method of forming and packaging stacked articles utilizing flexible packaging materials. The method of the invention comprises providing first and second streams of article groups. A continuous supply of a flexible packaging material, such as shrink or stretch film is positioned either across or adjacent the respective streams of article groups. The first stream of article groups is initially directed into the flexible packaging material so that the top surfaces of the article groups are provided with a base surface. Thereafter, the second stream of article groups is directed onto the base surfaces of the first stream of article groups to provide a stream of stacked article groups. Finally, the stacked article groups are united by forming a tight sheet of flexible packaging material about each stacked unit.

These and other benefits of this invention will become clear from the following description by reference to the drawings.

DESCRIPTION OF THE PREFERRED EMBODIMENT

Figure 1:
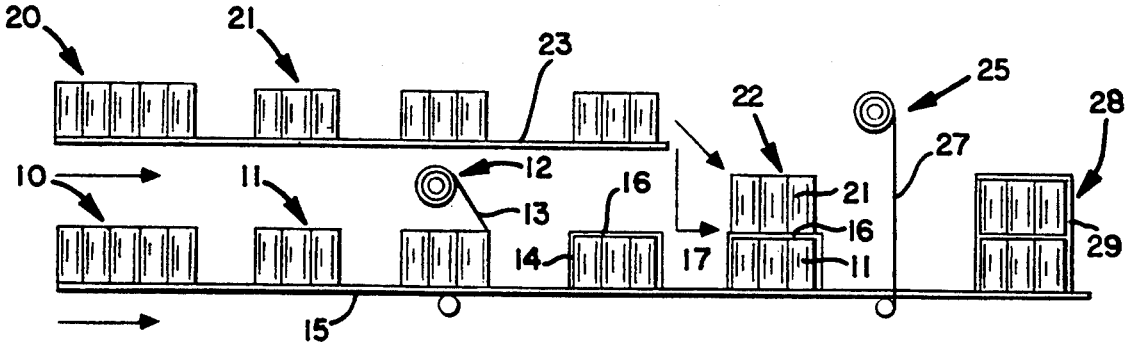
FIG. 1 is a flow diagram showing the method of this invention.

FIG. 1 is a flow diagram of the method wherein flexible packaging materials are used to form and package stacked article units. As shown, a first stream of articles 10 is provided on a conveyor 15, or the like, and formed into first article groups 11 as is known in the packaging art. For example, metering screws, variable speed conveyers, converging article lanes and guide structures may be utilized to form a continual supply of article groups 11, such as groups of beverage cans, containers, packages and the like.

A supply of flexible packaging material 12 is shown positioned across the line of travel of conveyor 15. The supply or roll 12 of flexible material, such as stretch or shrink film, is shown to have an unwound sheet portion 13 extending down to conveyor 15 so that each article group 11 is brought in contact with the unwound sheet 13 whereby each article group 11 is covered on its top. The sheet 13 is then severed from roll 12 via known means. The resultant severed portion of film 14 is shown to cover each article group 11 and importantly provides a top covered portion 16 which is utilized as a moving base member spacially removed from conveyor 15 for receiving a second article group. A length of packaging material 14 is shown to substantially cover the top of each article group 11.

As further shown in FIG. 1, as the first stream of article groups 11 is transported on conveyor 15, a second stream of articles 20 is provided on conveyor 23 and formed into a stream of second article groups 21 in a similar manner. The second stream of articles 20 is provided on a second horizontal plane whereby the second article groups 21 may be slid or otherwise moved via step 17 onto the packaging materials 16 positioned on the top of each first article group 11 to form stacked article groups 22. The moving or sliding step 17 may be accomplished by known means such as by pusher mechanisms, guide members or the like. The stacked article groups 22 are transported down stream on conveyor 15 and may be held in place by flight bars or the like until reaching the second roll of flexible material 25 which is positioned in line with conveyor 15. A sheet of flexible material 27 is shown extending downward so that it is in a taut position to capture each stacked article group 22. A length of flexible film 29 is severed in a known manner to unite the article groups 21 on top of groups 11 to form a stream of packaged stacked article units 28.

Figure 2:
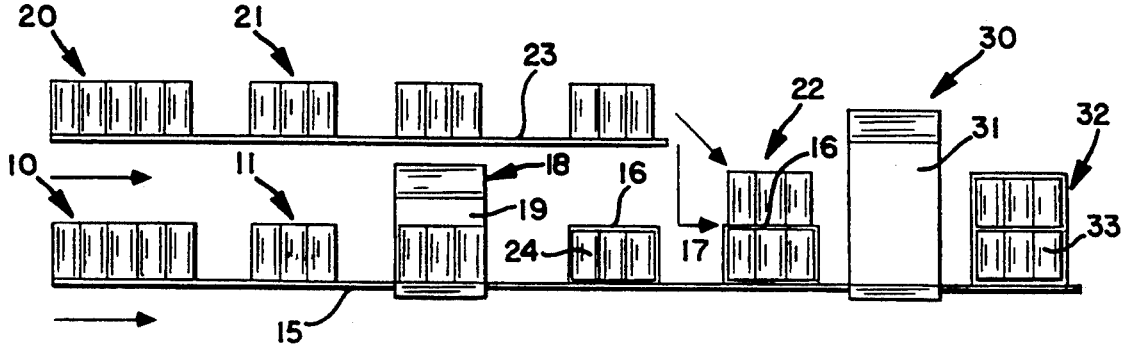
FIG. 2 is a flow diagram showing an alternate method of this invention.

The method of forming and packaging stacked article group units 28, as shown in FIG. 1, is particularly suited where the flexible packaging materials 12 and 25 comprise stretch film which clings and forms about articles which are moved into taut sheet portions. The method shown in FIG. 2 is similar to that of FIG. 1 except that a supply roll 18 of flexible packaging film is positioned adjacent conveyor 15 whereby the extended sheet of film 19 is brought perpendicularly around each article group 11 to form a wrap 24 having a top base covering 16 to permit the sliding movement of the second article groups 21 via step 17 to form stacked article groups 22. In a similar manner, a second supply roll 30 of flexible packaging material having its extended sheet of film 31 brought perpendicularly about the stacked article groups 22 is utilized to stretch exterior wraps of film 33 to form the packaged article units 32. As is known in the art, movable roller arms and film severing mechanisms are utilized to stretch wrap the film portions 33 about the stacked article groups 22.

Figure 3:
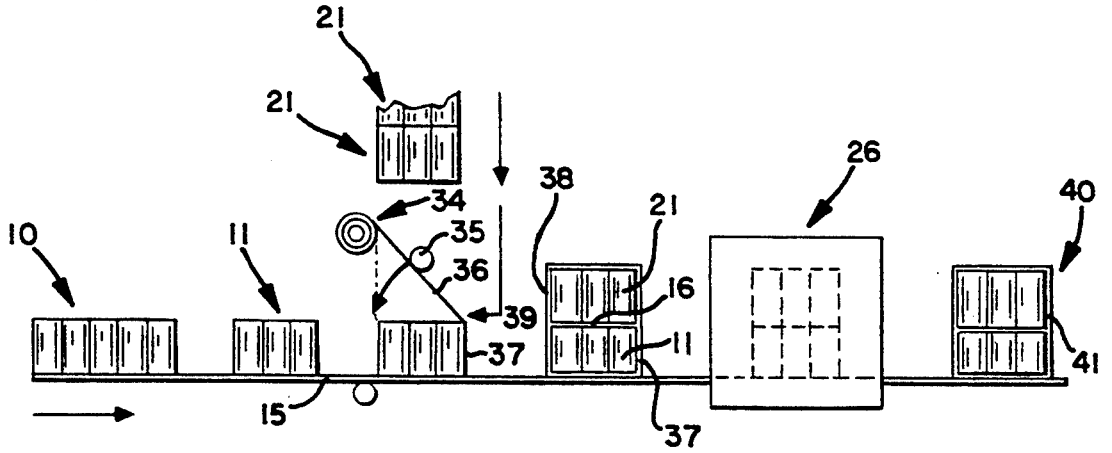
FIG. 3 is a flow diagram showing another method of this invention.

FIG. 3 is a flow diagram of a method of forming and packaging stacked article groups utilizing flexible shrink wrap film materials. As shown, the first and second streams of article groups 11 and 21 are provided in a manner similar to that of the methods of FIGS. 1 and 2. However, a supply roll of flexible packaging material 34 is provided whereby the extended web 36 is positioned about each article group 11 and maintained in an unsevered state until after the second article groups 21 are moved via step 39 on the top layer 16 and wrapped over the top groups 21. A movable roll 35 is shown to aid in the positioning and movement of the film web 36 so that film portions 38 are provided to wrap the stacked units of groups 11 and 21. Subsequent the wrapping and severing of the film, the film covered stacked units are moved through a heat tunnel 26 to provide packaged stacked article units 40 having exterior film wraps 41 tightly wrapped thereabout.

As many changes are possible to the embodiments of this invention utilizing the teachings thereof, the descriptions above, and the accompanying drawings should be interpreted in the illustrative and not the limited sense.

That which is claimed is:

1. A method to continuously form and package stacked article units utilizing flexible packaging film comprising:

a) moving first and second article group streams within reach of each other; said first and second article group streams being moved horizontally at distinct and different vertical levels;

b) positioning a supply of flexible film adjacent said first article group stream;

c) extending and wrapping a portion of flexible film about each first article group to encircle each first article group and to cover the top surface of each first article group to thereby form a base sliding surface thereon;

d) directing and sliding said second article groups onto the base sliding surfaces of the first article groups to form stacked article group units;

e) positioning a continuous sheet of flexible shrink film across the direction of travel of said stacked group units;

f) wrapping a portion of the continuous sheet of flexible shrink film about each stacked group unit; and g) uniting said stacked article group units by directing heat at the flexible shrink film wrapped about said article group units to form a stream of packaged stacked article units.

2. A continuous method to form and package stacked articles utilizing flexible packaging shrink film comprising:

a) providing first and second streams of article groups, said first and second article group streams being moved horizontally at distinct and different vertical levels;

b) positioning a continuous sheet of said flexible shrink film within reach of said stream of first article groups, said shrink film being provided in roll form;

c) extending a continuous sheet from said roll of shrink film across the direction of travel of said stream of first article groups;

d) directing said first stream of article groups into said continuous sheet of shrink film and substantially covering the top portions of said article groups;

e) directing and sliding said second stream of article groups onto the covered top portions of said first stream of article groups to form a stream of stacked article group units;

f) wrapping said continuous sheet of shrink film about each stacked article group unit;

g) severing said sheet of shrink film; and h) uniting said stacked article group units by directing heat to each stacked article group unit to thereby shrink said film about each said stacked article unit.

3. The method of claim 2, wherein said first stream of article groups provided is a stream of preselected first article groups and wherein said second stream of article groups provided is a stream of preselected second article groups.

4. A method to continuously form and package stacked article units utilizing flexible packaging film comprising:

a) moving first and second article group streams within reach of each other, said first and second article group streams being moved horizontally at distinct and different vertical levels;

b) positioning a supply of a first flexible packaging film within reach of said first article group stream;

c) extending and wrapping a portion of said first flexible film about each first article group to encircle each first article group and to cover the top surface of each first article group to thereby form a base sliding surface thereon;

d) directing and sliding said second article groups onto the base sliding surfaces of the first article groups to form a stream of stacked article group units;

e) providing a continuous sheet of a second flexible packaging film within reach of said stream of stacked article group units; and f) wrapping a portion of said second flexible film in taut communication about each said stacked article group unit, to thereby unite said stacked article group units to form a stream of packaged stacked article units.

5. The method of claim 4, wherein said first stream of article groups provided is a stream of preselected first article groups and wherein said second stream of article groups provided is a stream of preselected second article groups.

6. The method of claim 4, wherein said first flexible packaging film and said second flexible packaging film are continuous sheets each being provided in roll form.

7. The method of claim 4, wherein said first flexible packaging film and said second flexible packaging film are shrink film or stretch film.

8. The method of claim 6, wherein said first flexible packaging film is positioned across the direction of travel of said stream of first article groups.

9. The method of claim 6, wherein said first flexible packaging film is positioned adjacent the direction of travel of said stream of first article groups.

10. The method of claim 6, wherein said first and second group streams are moved horizontally at distinct and different vertical levels.

11. The method of claim 2, wherein said first and second group streams are moved horizontally at distinct and different vertical levels.

12. The method of claim 1, wherein said first stream of article groups provided is a stream of preselected first article groups and wherein said second stream of article groups provided is a stream of preselected second article groups.

* * * * *